US005228488A

United States Patent [19]

Fletcher

[11] Patent Number: 5,228,488

[45] Date of Patent: Jul. 20, 1993

[54] DISPENSING MEASURING FUNNEL

[76] Inventor: Scott W. Fletcher, 22 Brookline Ave., Haverhill, Mass. 01830

[21] Appl. No.: 867,472

[22] Filed: Apr. 13, 1992

[51] Int. Cl.[5] ..... B67D 5/60; B65B 1/04; B67C 11/00

[52] U.S. Cl. ..... 141/331; 141/344; 141/337; 141/362; 222/548; 222/460

[58] Field of Search ..... 141/331, 332, 337, 344, 141/345, 383, 386, 346, 360, 362, 364; 222/460, 568, 548, 555

[56] References Cited

U.S. PATENT DOCUMENTS

| | | | |
|---|---|---|---|
| 423,954 | 3/1890 | Richardson | 141/331 |
| 1,226,722 | 5/1917 | Sullivan | 141/331 X |
| 2,545,350 | 3/1951 | Fuld | 222/460 X |
| 3,029,003 | 4/1962 | Gronemeyer | 222/548 X |
| 3,325,844 | 6/1967 | Lampe | 141/364 X |
| 4,031,032 | 6/1977 | Jablecki | 141/344 X |
| 4,091,965 | 5/1978 | Gebhard | 222/548 X |
| 4,444,328 | 4/1984 | Glass | 222/548 X |
| 4,600,125 | 7/1986 | Maynard, Jr. | 141/331 X |
| 4,705,192 | 11/1987 | Knapton | 222/568 |

FOREIGN PATENT DOCUMENTS

| | | | |
|---|---|---|---|
| 20437 | of 1894 | United Kingdom | 141/345 |

*Primary Examiner*—Ernest G. Cusick
*Attorney, Agent, or Firm*—William Nitkin

[57] ABSTRACT

A funnel including measurement indicia discernible in relation to the contents therein, such funnel having a lower neck portion with an aperture therein and a collar member rotatably positioned on the neck portion with an aperture defined therein, such collar member in a first mode misaligning such apertures to retain the contents in the funnel and in a second mode rotated to align such apertures, to release the contents of the funnel through a spout member affixed below the collar member.

6 Claims, 1 Drawing Sheet

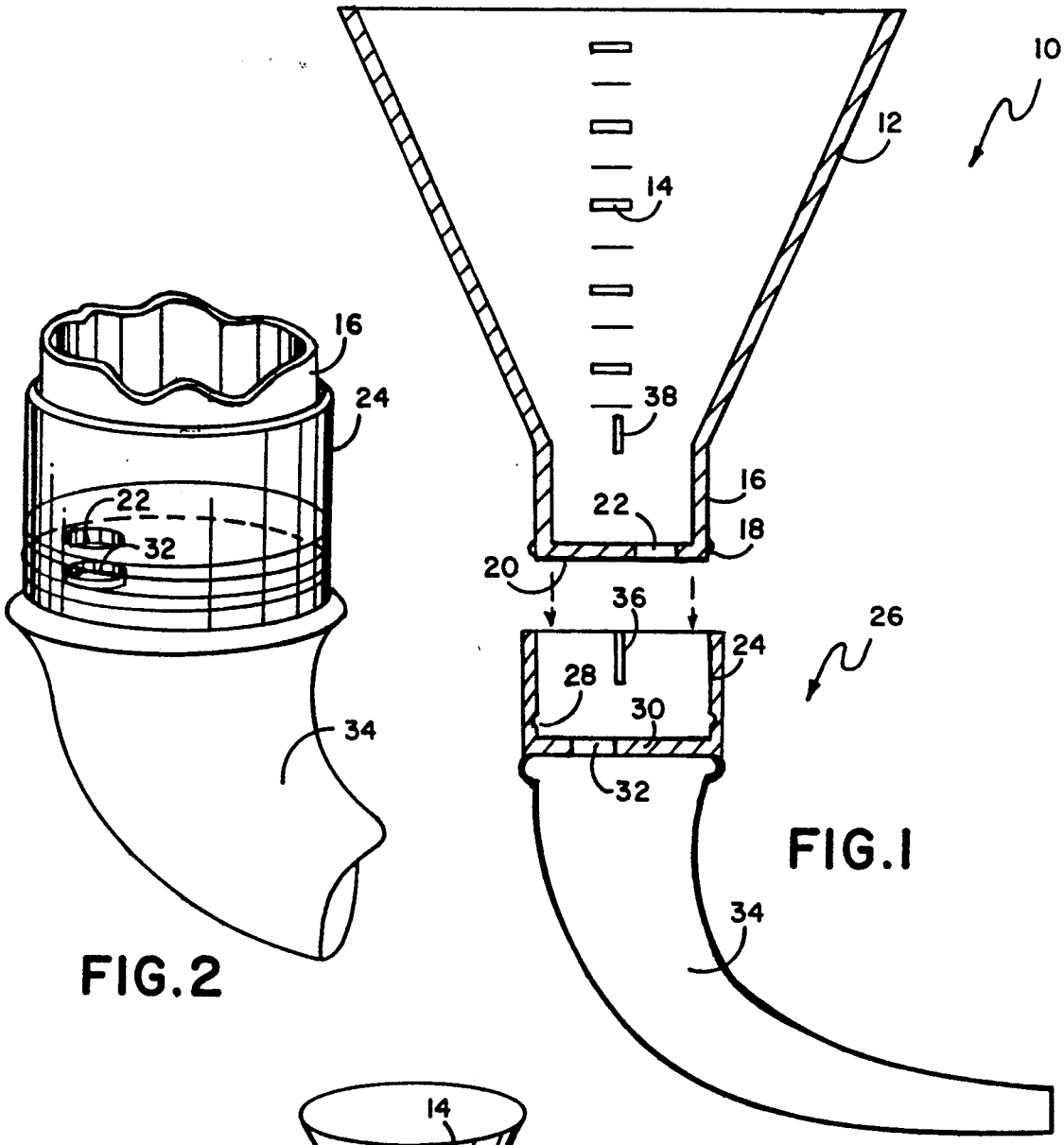
FIG.1
FIG.2
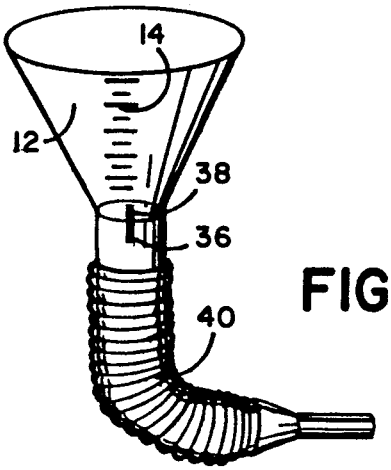
FIG.3

DISPENSING MEASURING FUNNEL

BACKGROUND OF THE INVENTION

1. Field of the Invention

The device of this invention resides in the area of funnels for fluid and other flowable materials and more particularly relates to a funnel that measures and controls dispensing of the contents thereof.

2. Description of the Prior Art

Funnels are well known in the prior art for directing volumes of fluids, particulates or other flowable materials from one source to a receptacle usually having a small opening. They are particularly useful for directing fluids into small openings such as, for example, oil into an oil receipt opening of an engine.

One problem associated with the use of funnels is that it is difficult to determine exactly how much material is placed in a funnel unless one starts with a known quantity as the flowable material placed in a funnel flows right out the funnel. Flexible funnel spouts are known in the art, especially for directing oil into automobile and motorcycle oil receipt openings. Some flexible spouts are accordian-like to retain their positioning until rebent. This feature is especially useful when oil receipt openings are placed in difficult-to-reach areas within motor vehicles. The use of such funnels avoids the mess of spilled oil.

SUMMARY OF THE INVENTION

It is an object of this invention to provide a funnel with closure means at the bottom of the funnel leading to the spout to control the flow of material placed therein.

It is a further object of this invention to provide measurement indicia on the funnel viewable from the exterior so that the amount of fluid or material placed in the funnel can be determined when the closure means of the funnel is in its closed mode.

The funnel of this invention can be of the type having an open conical shape or otherwise shaped. Along its exterior, perpendicular to an axis drawn through the center of the conical structure, are volume markings which can be, for example, standard U.S. measurement markings for pint, quart and ounce amounts or standard metric markings. The bottom of the funnel is provided with a neck portion and disposed at the bottom of the neck portion is a wall member having an off-centered first drain hole aperture having a diameter of less than one-half of the inner diameter of the wall member in the bottom of the neck portion. When this first drain hole aperture is blocked as will be described below and fluid is placed in the funnel, such fluid can be added up to a desired volume marking. In order to block off the first drain hole aperture, a cylindrical collar member having a wall member is utilized which collar wall member also has an aperture therein. The collar member is adapted to receive the neck portion of the funnel in a snug, fluid-tight relationship. The second wall member located at the bottom of the collar member also has an off-centered drain hole aperture which second drain hole aperture has a diameter of less than one-half of the inner diameter of the second wall member. The neck portion and collar member are round and when the neck portion of the funnel is inserted into the collar member, the collar member can rotated on the neck portion with the first and second wall members being adjacent to one another. In a first closed mode, the drain hole aperture in the wall member in the bottom of the neck portion of the spout is misaligned with the drain hole aperture in the wall member of the collar member so that no fluid can pass therethrough because the first wall member of the neck portion is positioned against the second wall member of the collar member in a fluid-tight relationship. With the two drain hole apertures misaligned, no opening is created in the bottom of the funnel. The closed mode of the funnel can be observed by the alignment of two vertical indicator marks or equivalent means placed on the funnel and on the collar member to indicate such misaligned positioning of the two drain hole apertures. One can rotate the collar member on the neck portion of the funnel as they are concentric, one being within the other. The collar member can be retained on the neck portion of the funnel by having an exterior lip positioned at the exterior of the bottom of the funnel neck portion engageable into a mating groove formed in the interior of the bottom of the collar member. When the collar member is rotated, it will then rotate the second wall member so as to align the two drain hole apertures, one above the other, and the contents of the funnel will drain out through the mated neck portion and collar member and out the spout attached at the bottom of the collar member. The funnel, collar member and spout can be made of transparent or translucent plastic of sufficient thickness so that they can maintain their shape when the funnel has material placed therein and so that such material can be seen through the funnel and its amount determined by height comparison to the measurement indicia on the body of the funnel. The spout disposed below the collar member can be made of flexible hose material including accordian-type material which when bent and can retain its bent shape until being manually rebent by the user of the funnel of this invention.

BRIEF DESCRIPTION OF THE DRAWINGS

FIG. 1 illustrates a side cross-sectional view of the funnel of this invention showing the funnel in its closed mode with its drain hole apertures misaligned.

FIG. 2 illustrates a sectional perspective view of a portion of the funnel of this invention in its open mode with its drain hole apertures in an aligned, open position.

FIG. 3 illustrates a side view of a funnel having an accordian-type spout.

DESCRIPTION OF THE PREFERRED EMBODIMENT(S)

FIG. 1 illustrates a side cross-sectional view of funnel 10 of this invention which has measurement indicia 14 of the U.S. system of measures and/or the metric system of measures, imprinted thereon. Upper portion 12 of funnel 10 is wider than the lower portion of the funnel and has slanted sides to achieve a funneling action when flowable material is added to the opening at the top of the funnel to direct such material into a much smaller opening at the top of a receiving container. At the bottom of funnel 10 is neck portion 16 which is cylindrical and extends down to first wall member 20 which is disposed perpendicular to an axis drawn through the funnel and having the circumference of the first wall member sealed with the inner circumference of the bottom of the neck portion. Within sealed first wall member 20 is defined first aperture 22. Aperture 22 has a diameter of less than one-half the inner diameter of first wall member 20. For example, if first wall member 20 is one inch in diameter, first aperture 22 can be ⅜ inch in diameter positioned completely to one side of a center axis line. Lip 18 can be disposed along the exterior of neck portion 16 which will be utilized as described below. Collar member 24 is a round, open cylinder and of a size adapted to receive neck portion 16 of funnel 10 snugly therein. At the bottom of collar member 24 is second wall member 30 having an off-centered second aperture 32 also positioned completely to one side of a center axis line drawn through the funnel. The diameter of second aperture 32 is less than one-half the inner diameter of second wall member 30. Groove 28 can be formed on the inside of collar member 24 and is positioned such that when neck portion 16 of funnel 10 is inserted into collar member 24, lip 18 formed on the exterior of neck portion 16 snaps into a fluid-tight, mating relationship with groove 28 in collar member 24. At the same time this engagement positions first wall member 20 of neck portion 16 of funnel 10 against second wall member 30 of collar member 24. When first and second apertures 22 and 32, respectively, are misaligned, first and second wall members 20 and 30 engage against one another in a fluid-tight relationship and the funnel is in its closed mode. A first indicator mark 38 can be placed on funnel 10 as seen in FIG. 1 and can be aligned with second indicator mark 36 disposed on the side of collar member 24. When both indicator marks are aligned, such alignment would indicate that first and second apertures 22 and 32 were misaligned and that the funnel was in its closed mode. Other equivalent indicator means could be utilized to indicate alignment or misalignment of first and second apertures 22 and 32. When the funnel is in its closed mode and fluid is poured into the funnel, such fluid stays in the funnel and one can measure the fluid in the funnel as it rises up and can be viewed within the sides of the conical-shaped, transparent or translucent funnel to the level desired. When the desired amount is in the funnel and one wishes to empty the contents of the funnel, one merely has to rotate collar member 24 such that first and second indicator marks 38 and 36 are misaligned and first and second apertures 22 and 32 are aligned to then drain the contents of the funnel therethrough. The fluid in funnel 10 then passes down through spout 34 affixed to said collar member which in FIG. 1 can be a flexible hose or, as seen in FIG. 3, can be of the accordian-shaped type which will assume and retain a bent position until manually bent into another position. Groove 28 and lip 18 can be disposed on either one of the mating elements and thus could be interchanged in position depending on the construction of the neck portion of the funnel and collar member as long as the lip and groove hold the collar member and spout onto the neck portion of the funnel. By only slightly overlapping first and second apertures and not completely aligning them, the speed of the flow of the material within the funnel can also be regulated if desired. The speed of the flow of material within the funnel can be increased by closer and closer alignment of first and second apertures 22 and 32 until first aperture 22 is completely above second aperture 32 for unrestricted and fastest flow.

Although the present invention has been described with reference to particular embodiments, it will be apparent to those skilled in the art that variations and modifications can be substituted therefor without departing from the principles and spirit of the invention.

I claim:

1. A funnel comprising:

an open, conical-shaped upper portion having an opening defined at its bottom, said upper portion having measurement indicia imprinted thereon relating to the quantity of material contained within said funnel;

a cylindrical neck portion having an open top, said neck portion integrally disposed on the bottom of said funnel, said funnel bottom opening forming the top opening of said neck portion;

a first wall member disposed at the bottom of said neck portion sealing said neck portion, said first wall member being circular in shape;

a first aperture defined in said first wall member, said aperture being positioned off center from an axis drawn through the center of said funnel, the diameter of said first aperture being less than one-half the inner diameter of said first wall member;

a cylindrical collar member rotatably concentrically engaged and interlocked on said neck portion;

a second wall member being circular in shape disposed within said collar member sealing said collar member;

a second aperture defined in said second wall member, said second aperture being positioned off center from an axis drawn through the center of said funnel, the diameter of said second aperture being less than one-half the inner diameter of said second wall member; and means to rotatably engage said collar member on said neck portion and align said first wall member against said second wall member in a first closed mode where said first and second apertures are off-set from one another and the contents of said funnel cannot drain therefrom; and in a second open mode when said collar member is rotated where said first and second apertures are aligned and the contents of said funnel can drain through said first and second apertures out of said funnel.

2. The funnel of claim 1 further including a flexible spout affixed to said collar member.

3. The funnel of claim 2 wherein said flexible spout includes adjustable means to retain its positioning.

4. The funnel of claim 1 wherein said upper portion of said funnel, said neck portion and said collar member are of transparent plastic.

5. The funnel of claim 1 further including:

a first indicator mark positioned on the upper portion of said funnel; and a second indicator mark positioned on said collar member such that when said first and second indicator marks are aligned, said funnel is in its closed mode and said first and second apertures are misaligned.

6. The funnel of claim 5 wherein said means to rotatably engage said collar member on said neck portion comprise:

said collar member having an inside;

a groove defined around the inside of said collar member;

said neck portion having an exterior; and a lip defined around the exterior of said neck portion with said lip engaged in said groove in said collar member.

* * * * *